US005943077A

United States Patent [19]

Zaba et al.

[11] Patent Number: 5,943,077

[45] Date of Patent: Aug. 24, 1999

[54] CONTINUOUS INK JET PRINTER PRINT HEAD

[75] Inventors: Jerzy Marcin Zaba, Histon; Richard Marsden, Cambs, both of United Kingdom

[73] Assignee: Domino Printing Sciences PLC, United Kingdom

[21] Appl. No.: 09/056,026

[22] Filed: Apr. 6, 1998

Related U.S. Application Data

[63] Continuation of application No. 08/760,486, Dec. 5, 1996, Pat. No. 5,767,880.

[30] Foreign Application Priority Data

Dec. 19, 1995 [GB] United Kingdom ..... 9525970

[51] Int. Cl.[6] ..... B41J 2/085

[52] U.S. Cl. ..... 347/76

[58] Field of Search ..... 347/74, 75, 76

[56] References Cited

U.S. PATENT DOCUMENTS 4,277,790 7/1981 Heibein et al. ..... 347/77
4,305,079 12/1981 Mix, Jr. .
4,347,520 8/1982 Paranjpe et al. .
4,413,265 11/1983 Kockler et al. .
4,573,057 2/1986 Sutera et al. .
5,473,353 12/1995 Soucemarianadin et al. ..... 347/74

FOREIGN PATENT DOCUMENTS

WO94/16898 8/1994 WIPO .

OTHER PUBLICATIONS

Movable Ink Jet Gutter, IBM Technical Disclosure Bulletin vol. 23, No. 1, Jun. 1980 G.W. Hieronymus et al.

*Primary Examiner*—N. Le
*Assistant Examiner*—Thien Tran
*Attorney, Agent, or Firm*—Robert F. I. Conte; Lee, Mann, Smith, McWilliams, Sweeney & Ohlson

[57] ABSTRACT

A print head for a continuous ink jet printer has a nozzle through which ink is emitted and broken up into droplets under the action of a piezoelectric oscillator. A charge electrode applies charge to selected droplets and a deflection electrode deflects the path of the charged droplets to cause printing on a substrate. A gutter collects droplets which are not required for printing. A charge electrode, together with one of the deflection electrodes is movable in a direction transverse to the path of the droplets selectively under the action of pressurized ink fed from an ink supply. Similarly, the gutter is movable in the same way by another actuator.

8 Claims, 1 Drawing Sheet

CONTINUOUS INK JET PRINTER PRINT HEAD

This is a continuation of our allowed application Ser. No. 08/760,486 filed Dec. 5, 1996, now U.S. Pat. No. 5,767,880.

FIELD OF THE INVENTION

The present invention relates to so-called "continuous ink jet printers" of the type in which a stream of ink is emitted under pressure from a nozzle and, by the action of a piezoelectric oscillator, is broken up into droplets which can be selectively charged and then deflected in an electric field onto a substrate. Such printers are well known in the art.

Although such printers have been available for many years, problems arise still during the start-up of such a printer. Frequently, the stream of ink issuing from the nozzle is unstable at start-up and this can cause ink to impinge on components of the print head undesirably. In particular, ink impinging on the electrode used to charge the droplets can cause unstable conditions to persist and charging to be inaccurate with the result that droplets are not correctly placed on the substrate.

Also during start-up, there is a need to ensure that guard droplets and non-printable droplets pass correctly into the gutter which is provided for their collection. Additionally, when the printer is of the type in which uncharged droplets are "printed" and charged droplets are either guard drops or non-printable drops, when the printer is first switched on and the stream of ink starts to issue from the nozzle, it is desirable to avoid wastage of ink or the unnecessary application of ink to part of a substrate which will then not be to be used.

SUMMARY OF THE INVENTION

According to the present invention, there is provided a print head for a continuous ink jet printer, the print head having ink supply means for supplying ink under pressure to a nozzle through which ink is emitted in use and broken up into droplets by the action of a piezoelectric oscillator, a charge electrode for applying electrostatic charge to selected droplets in use, a deflection electrode for deflecting the path of charged droplets, and a gutter for collecting droplets not required for printing, wherein the charge electrode or the gutter is movable in a direction transverse to the path of the droplets, the movement being controlled by the action of pressurised ink selectively supplied from the ink supply means to a hydraulic actuator or actuators coupled to the charge electrode or the gutter respectively.

Thus, during start-up, the charge electrode may be withdrawn from its normal operating position laterally to avoid being spattered by ink droplets. The gutter may be positioned so that all droplets issuing from the nozzle during the start-up phase, whether charged or not, pass into the gutter and do not pass to the underlying substrate.

Advantageously, the deflection electrode is mounted for movement with the charge electrode.

The invention also includes a print head constructed such that the charge electrode is moved laterally out of its normal operating position so that it is withdrawn from proximity to the stream of droplets. In a further construction according to the invention, the gutter is laterally moved at start-up so that all droplets issuing from the nozzle, whether charged or not, pass into the gutter.

BRIEF DESCRIPTION OF THE DRAWINGS

One example of a print-head according to the present invention will now be described with reference to the accompanying drawings, in which.

DESCRIPTION OF THE PREFERRED EMBODIMENT

Figure 1:
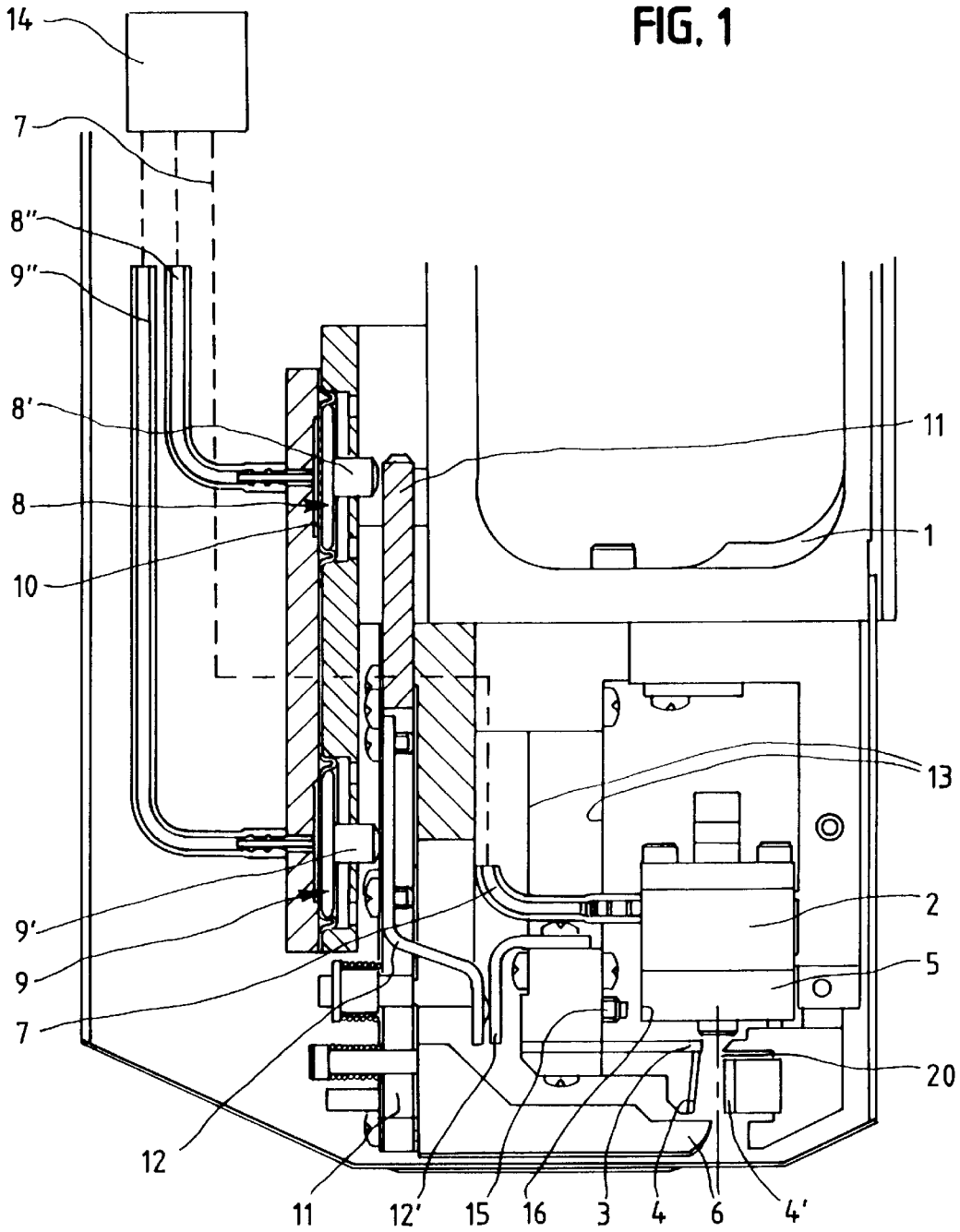
FIG. 1 illustrates the print head in side view, partially cross-sectioned.

The print head has an electronics sub-system 1 by means of which are controlled the piezoelectric oscillator in a droplet generator 2, and the application of appropriate voltages to charge electrodes 3 and deflection electrodes 4,4' and by means of which appropriate signals are given to valves 15,16 (not shown in FIG. 1, but see FIGS. 2 & 3) in the printer cabinet (not shown) controlling the flow of ink to the droplet generator 2.

The droplet generator 2 has a nozzle plate 5 with a plurality of closely spaced nozzles arranged in a row (normal to the plane of the drawing) and from which issue, in use, streams of ink 20 (the plane of which is thus normal to the plane of the figure) which, under the action of the piezoelectric oscillator, break up into individual droplets for printing purposes. The droplets pass individual charge electrodes 3 (seen end-on in the drawing), also arranged in a row in the same direction, where they are selectively charged and then passed between the pair of deflection electrodes 4, 4' which establish, in use, an electric field by means of which charged droplets are deflected from their straight-line path into a gutter 6. In the start-up position of the gutter 6 (not shown in the drawing) even uncharged droplets (which in the present case are used for printing) pass into the gutter.

In use ink is supplied from a supply means 14 to an ink chamber (not shown) within the drop generator 2 above the nozzle plate 5, via a feed line 7 and is also supplied to first 8 and second 9 hydraulic actuators, via lines 8" and 9", through the action of the appropriate valves mounted in the printer cabinet (not shown).

The first actuator 8, which is supported on a bracket 10, has a piston 8' which is arranged to bear against one end of a lever arm 11 at the other end of which is mounted the gutter 6. The second actuator 9 is also mounted on the bracket 10 and has a piston 9' which engages, via a pair of links 12, 12', a flexible support bracket 13 for the charge electrodes 3 and the deflection electrode 4.

By selectively operating the valves which control the supply of pressurised ink to the first and second actuators 8, 9 respectively, the gutter 6 can be withdrawn from the "catch-all" position into the position shown in the drawing which is an operating position in which only charged droplets are deflected into the gutter, non-charged droplets being allowed to pass onto the substrate for printing, and the charge electrodes 3 and deflection electrode 4 can be moved rightwards from the position shown in the drawing, to a position in which the charge electrodes 3 are closely adjacent the streams of droplets 20 and the deflection electrode 4 is in the appropriate position relative to the other deflection electrode 4'. This position is defined by an adjustable stop screw 15 which bears against an abutment 16 on the side of the nozzle plate 5.

The start/stop sequence described below uses four solenoid valves; jet, bleed, charge electrode actuator and gutter actuator, none of which are shown in the drawings.

The jet solenoid valve (aka the feed solenoid) is a two-way solenoid valve which is mounted in the print head and controls the flow of ink to the drop generator 2 through the feed line 7.

The bleed solenoid is a similar type of valve to the jet/feed solenoid valve and is also mounted in the print head and controls flow through a bleed line (not shown). When open, it allows a flow of ink through the bleed line from the drop generator 2 primarily to remove ingressed air during start up. During shut down it is also opened to cause a very quick jet shut off by de-pressurising the drop generator. This is helped by connecting the bleed to a vacuum source (not shown) which is used to draw ink from the gutter 6.

The charge electrode actuator valve is a three-port solenoid valve mounted in the ink cabinet. When activated ink is supplied to the actuator 9 so that the charge electrode 3 moves into the print position. When de-activated, the charge electrode 3 returns to its 'safe', jet start position (as shown in the drawing).

The gutter actuator valve is similar to the charge electrode actuator valve and is mounted in the cabinet. When activated, it causes ink to flow to the gutter actuator 8 which moves the gutter 6 into the print position (as shown). When deactivated the gutter 6 is in the "catch all" position needed for jet start up and shut down, rightwards of the position shown in the drawing.

The start up sequence is as follows:

With both the gutter and charge electrode actuator solenoid valves off (the gutter in the catch all position, the charge electrode in the jet start position) the feed pressure and gutter pumps start.

Following a jet start request, the jet solenoid valve opens. The jets start (which causes the pressure to drop). However, the actuators 8,9 require a certain pressure to operate so if the pressure drops below this value the sequence must wait until the pressure reaches this value.

After ten seconds, the bleed valve opens for ten seconds which causes another drop in the pressure. Again, the pressure control system can ignore this drop, so long as it is above the minimum pressure.

Once the bleed valve closes the pressure control system can establish the pressure required for the current operating parameters. Once the correct pressure is established the charge electrodes 3 are moved rightwards into the operating position by activating the charge electrode solenoid valve. At this point, modulation, phasing, jet velocity measurement and charging can start.

Once this has been completed the jets should be being deflected into the back of the gutter 6. At this stage it is safe to move the gutter to the print position shown, by activating the gutter actuator 8. At this stage printing can start.

This sequence is summarised in Appendix A.

The jet stop sequence begins with the gutter actuator 8 closing so that the gutter 6 returns to the catch all position. It is then safe to stop charging, phasing and modulation and move the charge electrodes 3 to the 'safe' position by de-activating the charge electrode actuator 9. Like the jet start sequence, the jet stop sequence begins with setting the pressure. Once this has been established the bleed solenoid valve opens. After ten seconds, the jet solenoid valve closes shortly followed by the bleed solenoid valve.

As with the start sequence, the pressure control system need not try to maintain the generating pressure and pressure control faults should be ignored. After the jets have been turned off, the pumps should continue to run, to clear the gutter, before being turned off.

This sequence is summarised in Appendix B.

Although the preferred embodiment utilises the pressurised ink to actuate actuators 15,16 for both the charge electrode(s) 3 and the gutter 6, it should be understood that the pressurised ink can be used to operate either the charge electrode(s) 3 or the gutter 6 independently.

Figure 2:
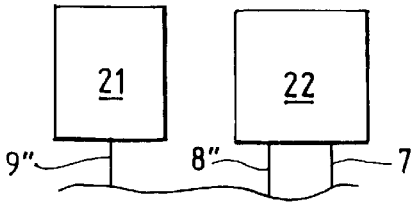
FIG. 2 is a partial view of the pressurised ink supply for the printer of FIG. 1; and, FIG. 3 is a partial view of another pressurised ink supply for the printer of FIG. 1.
Figure 3:
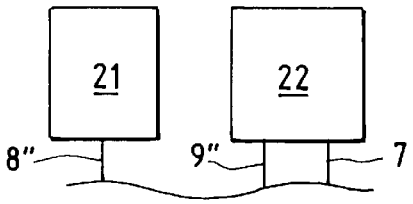

As shown in FIG. 2, a supply of pressurised ink in the supply means 14 is fed via a solenoid valve 15 to the line 9" to operate the charge electrode(s) 3 via the actuator 9. In FIG. 3, the pressurised ink from the supply means 14 is fed to via solenoid valve 16 to the line 8" to operate the gutter 6 via the actuator 8.

Appendix A

Start Up Sequence Summary

Jet On Requested (with pumps already running)
Charge electrode and gutter actuators off
Set feed pressure
Open jet solenoid valve
Wait 10 seconds
Open bleed solenoid valve
Wait 10 seconds
Close bleed solenoid valve
Set the correct pressure for current operating conditions
Turn on charge electrode actuator
Start modulating, charging and phasing
Set correct jet velocity, phase charge etc
Turn on gutter actuator
Turn on green beacon if all ok

Appendix B

Shut Down Sequence Summary

Jet Off Requested (from a printing state)
Turn off green beacon
Turn off gutter actuator
Stop charging and modulation
Turn off charge electrode actuator
Set pressure
Open bleed solenoid valve
Wait 10 seconds
Turn off jet solenoid valve
Wait 200 milliseconds
Turn off bleed solenoid valve
Wait 120 seconds
Turn off pumps

We claim:

1. A printhead for a continuous ink jet printer having an ink supply means for supplying ink under pressure to the print head, the print head comprising:

at least one nozzle through which said ink under pressure is emitted in use and broken up into droplets;

at least one nozzle charge electrode for applying electrostatic charge to selected droplets in use;

at least one deflection electrode for deflecting a path of the charged selected droplets;

a gutter for collecting said charged selected droplets not required for printing; and at least one hydraulic actuator coupled to the at least one charge electrode, said ink supply means supplies said ink under pressure from the ink supply means to both said at least one hydraulic actuator and said at least one nozzle;

wherein movement of the at least one movable charge electrode is in a direction transverse to the path of the droplets, and said movement is controlled by said ink under pressure selectively supplied to the at least one actuator.

2. A print head according to claim 1, wherein the at least one deflection electrode is mounted for movement with the at least one charge electrode.

3. A print head according to claim 1, wherein the at least one charge electrode is biased to a non-operating position.

4. A print head according to claim 1, wherein the at least one charge electrode is moved laterally out of said at least one charge electrode's normal operating position so that said at least one charge electrode is withdrawn from proximity to the stream of droplets.

5. A print head according to claim 4, constructed such that, during start-up, the at least one charge electrode is withdrawn from said at least one charge electrode's normal operating position laterally to avoid being spattered by ink droplets.

6. A print head for a continuous ink jet printer having an ink supply means for supplying ink under pressure to the print head the print head comprising:

at least one nozzle through which said ink under pressure is emitted in use and broken up into droplets;

at least one charge electrode for applying electrostatic charge to selected droplets in use;

at least one deflection electrode for deflecting a path of the charged selected droplets;

a movable gutter for collecting said charged selected droplets not required for printing; and at least one hydraulic actuator coupled to the gutter, wherein the ink supply means supplies said ink under pressure to said at least one hydraulic actuator;

wherein movement of the movable gutter is in a direction transverse to the path of the droplets, and said movement is controlled by said ink under pressure selectively supplied to the at least tone actuator.

7. A print head according to claim 6, wherein the gutter is biased to a non-operating position.

8. A print head according to claim 6, wherein the gutter is positioned so that all droplets issuing from the nozzle, whether charged or not, pass into the gutter.

* * * * *